US008540240B2

(12) United States Patent
Deno et al.

(10) Patent No.: US 8,540,240 B2
(45) Date of Patent: Sep. 24, 2013

(54) SHEET CONVEYING APPARATUS AND IMAGE FORMING APPARATUS

(75) Inventors: Kohei Deno, Moriya (JP); Masaki Maeno, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/602,832

(22) Filed: Sep. 4, 2012

(65) Prior Publication Data

US 2013/0056926 A1 Mar. 7, 2013

(30) Foreign Application Priority Data

Sep. 7, 2011 (JP) ..... 2011-195286

(51) Int. Cl.
*B65H 7/02* (2006.01)
*B65H 9/04* (2006.01)

(52) U.S. Cl.
USPC ..... 271/228; 271/242

(58) Field of Classification Search
USPC ..... 271/242, 228
See application file for complete search history.

(56) References Cited

U.S. PATENT DOCUMENTS 8,348,266 B2 1/2013 Deno
2004/0094891 A1* 5/2004 Trovinger et al. ..... 271/227

FOREIGN PATENT DOCUMENTS

JP 6-336353 A 12/1994
JP 6-345294 A 12/1994
JP 2003-063698 A 3/2003
JP 4016621 B2 12/2007

* cited by examiner

*Primary Examiner* — David H Bollinger
(74) *Attorney, Agent, or Firm* — Fitzpatrick, Cella, Harper & Scinto

(57) ABSTRACT

A sheet conveying apparatus has an upstream roller and a registration roller configured so that the sheet conveyed by the upstream roller abuts the registration roller to form a loop in the sheet to correct for skew. The skew of the sheet is corrected for by the leading edge of the sheet abutting the registration roller to bend the sheet so as to form the loop in the sheet. A resist sensor detects a time difference of passing time between the advanced leading edge and the retarded leading edge in the downstream leading edge of the sheet conveyed by the upstream roller, detects the skew amount of the sheet based on the time difference, and changes the backward rotation time of the registration roller depending on the skew amount.

8 Claims, 15 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus such as a printer or photocopier including the same.

2. Description of the Related Art

In general, it is known that an image forming apparatus such as a laser beam printer or color photocopier includes a sheet conveying apparatus which conveys a sheet fed from a sheet feeding cassette or a manual feeding tray into the image forming apparatus.

In a sheet conveying apparatus, it is also known that the sheet is conveyed along a conveying path with the leading edge of the sheet in a skew feeding state slightly rotated with respect to the conveying direction due to such as a difference of the conveying speed by conveying rollers or a misalignment of the image transferring portion of the conveying rollers. If an image is formed with the sheet conveyed in a skew feeding state like this, it becomes a cause for forming a bad image such as an image formed on the sheet bent with respect to the sheet.

Therefore, conventionally, a sheet conveying apparatus has a skew correction apparatus which corrects for the skew feeding of a sheet to prevent the sheet from being conveyed in a skew feeding state. The skew correction apparatus includes a registration roller (downstream roller) for conveying the sheet to the transferring portion and an upstream roller for conveying the sheet to the registration roller. In addition, the sheet conveyed by the upstream roller abuts the registration roller and bends the sheet itself to form a loop therein, thereby correcting for the skew feeding of the sheet.

In the conventional skew correction apparatus, a loop is formed in the sheet by the leading edge of the sheet abutting a nip portion of the registration roller in a stop state (non-rotating state). Conveying the sheet to the registration roller by the upstream roller continues until the whole of the sheet leading edge abuts the nip portion of the registration roller, and the sheet itself is rotated to correct for the skew feeding of the sheet (See Japanese Patent Laid-Open Nos. 6-336353 and 6-345294).

However, in the conventional skew correction apparatus, if the rigidity of the sheet conveyed from the upstream roller is high and the leading edge of the sheet abuts the nip portion of the registration roller in a skew feeding state, the leading edge of the sheet encroaches on the nip portion of the registration roller. If the leading edge of the sheet encroaches on the nip portion of the registration roller like this (the state in which the sheet is squeezed into the registration roller), the sheet is made immovable by the registration roller.

Even if a loop is formed by bending the sheet in such a state, the sheet itself cannot rotate because it is made immovable by the registration roller, and the skew feeding of the sheet cannot be corrected for.

Therefore, conventionally, a sheet conveying apparatus, which is provided with a skew correction apparatus for preventing the sheet from encroaching on the nip portion of the registration roller by rotating the registration roller backward in a direction reverse to the rotation for conveying the sheet, has been devised (See Japanese Patent No. 4016621).

By rotating the registration roller backward, it is clearly possible to resolve the sheet-encroaching state even if the sheet has encroached on the nip portion of the registration roller, and it is also possible to prevent the sheet from encroaching on the registration roller.

However, in the sheet conveying apparatus described in the Japanese Patent No. 4016621, the registration roller is rotated backward a given amount regardless of the extent of the amount of encroachment of the sheet on the registration roller. Thus, if the registration roller is rotated backward a given amount even when the amount of encroachment of the sheet on the registration roller is small, there is a concern that damage such as "leading edge curling" or "leading edge folding" may occur in the sheet due to the backward rotation of the registration roller as illustrated in FIGS. 13A and 13B.

Especially when the surface of the registration roller is made of rubber material, in case of the leading edge of the sheet being curled or the like, the leading edge of the sheet is caught by the surface of the roller because the friction coefficient of the rubber surface is high, whereby the above-mentioned "leading edge curling" or "leading edge folding" is apt to occur.

Thus, it is desirable to provide a sheet conveying apparatus in which the above-mentioned problem is solved by changing the backward rotation time for rotating the downstream roller backward based on the skew amount of the conveyed sheet.

SUMMARY OF THE INVENTION

The sheet conveying apparatus of the present invention, in which a loop is formed in a sheet between an upstream roller and a registration roller by the registration roller abutting the sheet conveyed by the upstream roller to correct for the skew feeding of the sheet, includes a driving apparatus which rotates the registration roller forward or backward with respect to the sheet conveying direction, a detection portion which detects a skew amount of the sheet before the sheet abuts the registration roller, and a controller which determines the backward rotation amount for the downstream roller to rotate backward based on the detection results of the detection portion and controls the driving apparatus to rotate the downstream roller backward based on the backward rotation amount determined by the controller with the sheet conveyed by the upstream roller abutting the downstream roller.

According to the present invention, the backward rotation time of the registration roller which the leading edge of the sheet abuts is changed to correct for the skew feeding of the sheet, based on the detected skew amount. By this, the registration roller makes a minimum required backward rotation at the time of skew correction of the sheet, so that it is possible to resolve the state in which the leading edge of the sheet encroaches on the nip portion of the registration roller and reduce the occurrence of "leading edge curling" or "leading edge folding" of the leading edge of the sheet.

Further features of the present invention will become apparent from the following description of exemplary embodiments with reference to the attached drawings.

DESCRIPTION OF THE EMBODIMENTS

Hereinafter, exemplary embodiments of the present invention will be described in detail with reference to the accompanying drawings.

Figure 1:
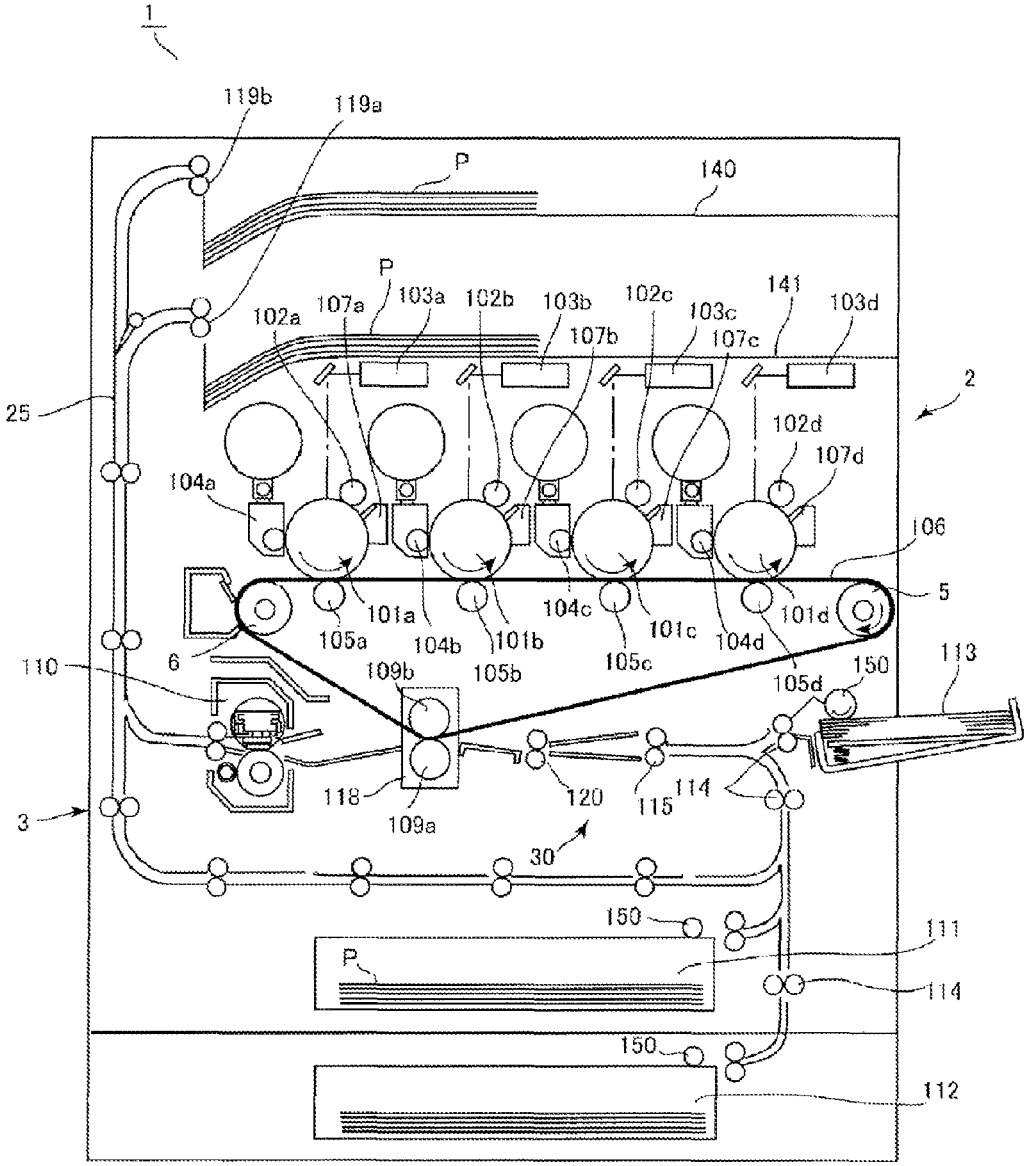
FIG. 1 is a cross-sectional view showing a schematic configuration of an image forming apparatus having a sheet conveying apparatus.

A digital color printer 1 (hereinafter referred to in brief as a "printer"), which is an example of an image forming apparatus according to an embodiment of the present invention, is formed in rectangular shape when seen from a side, as illustrated in FIG. 1. In the upper side of the printer, sheet discharging trays 140 and 141 are installed in two upper and lower stages respectively for discharging a sheet P with an image formed thereon, and in the lower side thereof, an image forming portion 2 for forming an image on the sheet P is installed. In the lower side of the image forming portion 2, sheet feeding cassettes 111 and 112 are installed in two upper and lower stages for stacking the sheet P on which the image is to be formed. The sheets P of these sheet feeding cassettes 111 and 112 are conveyed to the image forming portion 2 and sheet discharging trays 140 and 141 by a sheet conveying apparatus 3.

First, the image forming portion 2 will be described in detail. The image forming portion 2 installed in the printer 1 has laser beam scanners 103*a* to 103*d* of a four-drum full color type, as illustrated in FIG. 1. The image forming portion 2 also includes four image forming units including photosensitive drums 101*a* to 101*d*, charging rollers 102*a* to 102*d*, development devices 104*a* to 104*d* and cleaners 107*a* to 107*d*. These four image forming units form toner images of four colors of yellow (Y), magenta (M), cyan (C), and black (Bk). The photosensitive drums 101*a* to 101*d* are configured to rotate in an arrow direction illustrated in FIG. 1 by the driving force of a driving apparatus not illustrated.

As illustrated in FIG. 1, primary transferring rollers 105*a* to 105*d* are arranged facing the respective photosensitive drums 101*a* to 101*d*. An intermediate transfer member belt 106, which is supported by the respective photosensitive drums 101*a* to 101*d* and the primary transferring rollers 105*a* to 105*d*, passes between the respective photosensitive drums 101*a* to 101*d* and the primary transferring rollers 105*a* to 105*d*.

The intermediate transfer member belt 106 is wound on a driving roller 5, a tension roller 6 and a secondary transferring opposite roller 109*b*, the driving roller 5 rotates in the arrow direction as illustrated in the drawing, and the intermediate transfer member belt 106 also rotates in the same direction as the driving roller 5. A fixing portion 110 is installed near a secondary transferring portion 118.

Next, the image forming operation of the image forming portion 2 of the printer 1 configured as described above will be described. When the image forming operation starts and image signals of four colors of yellow (Y), magenta (M), cyan (C), and black (Bk) are input into the laser beam scanners 103*a* to 103*d*, the laser beam scanners 103*a* to 103*d* emit laser beams.

The surfaces of the photosensitive drums 101*a* to 101*d* are charged with uniform electric charge beforehand by charging rollers 102*a* to 102*d* and the charged surfaces are irradiated with laser beams emitted by the laser beam scanners 103*a* to 103*d*. By the irradiation with laser beams by the laser beam scanners 103*a* to 103*d*, electrostatic latent images of yellow, magenta, cyan, and black are formed on the photosensitive drums 101*a* to 101*d*.

The electrostatic latent images formed on the photosensitive drums 101*a* to 101*d* are developed by yellow, magenta, cyan, and black toners to be visualized by the development devices 104*a* to 104*d*. The toners developed on the respective photosensitive drums 101*a* to 101*d* are sequentially transferred to the intermediate transfer member belt 106 as transfer bias is applied to the intermediate transfer member belt 106 from the primary transferring rollers 105*a* to 105*d*, so as to form a full color image on the intermediate transfer member belt 106. After being transferred, the toners remaining on the photosensitive drums 101*a* to 101*d* are removed by the cleaners 107*a* to 107*d* to be prepared for the next image forming.

Meanwhile, the sheet P to which the full color image formed on the intermediate transfer member belt 106 is to be transferred is fed from the sheet feeding cassettes 111 and 112 or a manual feeding portion 113. The uppermost sheet P is separated from the sheet bundle stacked in the sheet feeding cassettes 111 and 112 by a pickup roller 150 and is fed to the conveying apparatus 3 by conveying rollers 114. Further, by feeding from the manual feeding portion 113, the same uppermost sheet P is separated to be fed to the sheet conveying apparatus 3.

The skew of the sheet P fed to the sheet conveying apparatus 3 from the sheet feeding cassettes 111 and 112 or the manual feeding portion 113 is corrected for by the sheet conveying apparatus 3 before it is synchronized with the leading edge of the image on the intermediate transfer member belt 106 and is conveyed to the secondary transferring portion 118. The image formed on the intermediate transfer member belt 106 is transferred to the sheet P conveyed to the secondary transferring portion 118 by the secondary transfer bias applied to the secondary transferring roller 109*a*, and the sheet P is conveyed to the fixing portion 110. The sheet P is heated and pressed in the fixing portion 110, so that the toner image on the sheet P is melted and mixed for the image to be fixed on the sheet.

The sheet P with the image fixed in the fixing portion 110 passes the conveying path 25 to be discharged from the discharging portion 119*a* or 119*b* to the sheet discharging trays 140 and 141.

Figure 2:
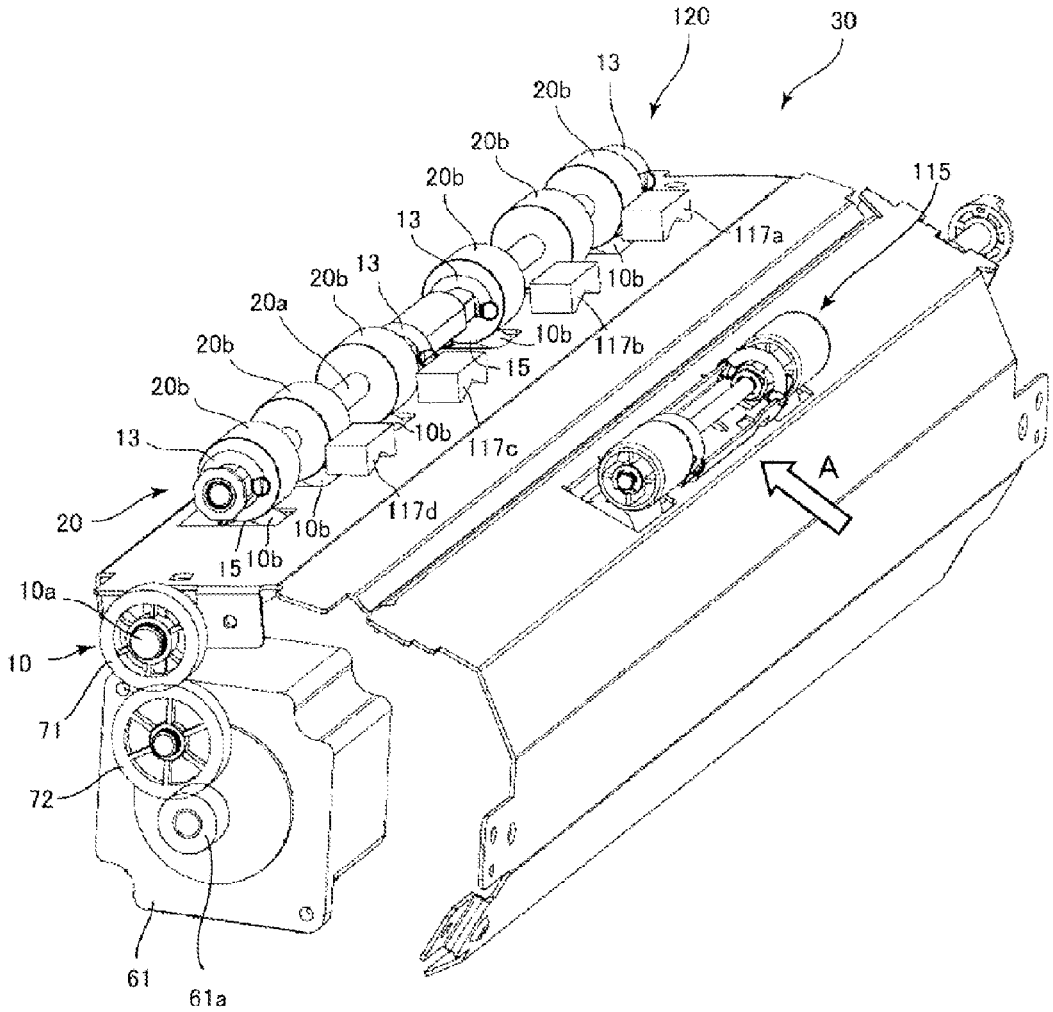
FIG. 2 is an exploded perspective view of a skew correction apparatus provided in the sheet conveying apparatus.

Next, the sheet conveying apparatus 3 will be described in detail. The sheet conveying apparatus 3 includes a skew correction apparatus 30 which corrects for the skew of the conveyed sheet P. The skew correction apparatus 30 includes a registration roller 120 as a downstream roller which conveys the sheet P to the secondary transferring portion 118 and an upstream roller 115 which conveys the sheet P to the registration roller 120, as illustrated in FIG. 2. The skew correction apparatus 30 includes a resist motor 61 as a driving apparatus which rotates the registration roller 120 forward or backward with respect to the sheet conveying direction. Further, the sheet conveying apparatus 3 includes resist sensors 117*a* to 117*d* which are a detection portion arranged across the sheet conveying direction in a position more upstream than the registration roller 120 to detect the leading edge of the sheet P and the skew amount S of the sheet. The resist sensors 117*a* to 117*d* (hereinafter referred to in brief as numeral 117 to indicate all of the resist sensors) include optical sensors, for instance CCD (Charge Coupled Device) image sensors.

Here, the registration roller 120 will be described in detail. The registration roller 120 includes, as illustrated in FIG. 2, a lower resist roller 10, both ends of which are journaled, and which can rotate forward or backward with respect to the sheet conveying direction, and an upper resist roller 20, both ends of which are also journaled, and which can rotate forward or backward with respect to the sheet conveying direction.

The lower resist roller 10 is formed as one body with a plurality of rubber rollers 10*b* attached to a metal shaft 10*a*. A gear 71 is mounted at one end of the metal shaft 10*a*, and is connected to an output shaft 61*a* of the resist motor through a gear 72. The upper resist roller 20 is also formed as one body with a plurality of rubber rollers 20*b* attached to a metal shaft 20*a*. The outer shape of the rubber roller 10*b* itself is formed to 20Ø, and the outer shape of the roller 20*b* itself is also formed to 20Ø like the rubber roller 10*b*. Further, the roller 20*b* is made of polyacetal (POM).

The upper resist roller 20 and the lower resist roller 10 are arranged facing each other so that the roller 20*b* attached to the upper resist roller 20 and the rubber roller 10*b* attached to the lower resist roller 10 contact each other. The upper resist roller 20 and the lower resist roller 10 are pressed by springs 13 mounted respectively on a plurality of unillustrated bearing portions that bear the upper resist roller 20. Therefore, as illustrated in FIG. 2, the nip portion 15 is formed at the position at which the rubber roller 10*b* and the roller 20*b* come into contact.

Figure 3:
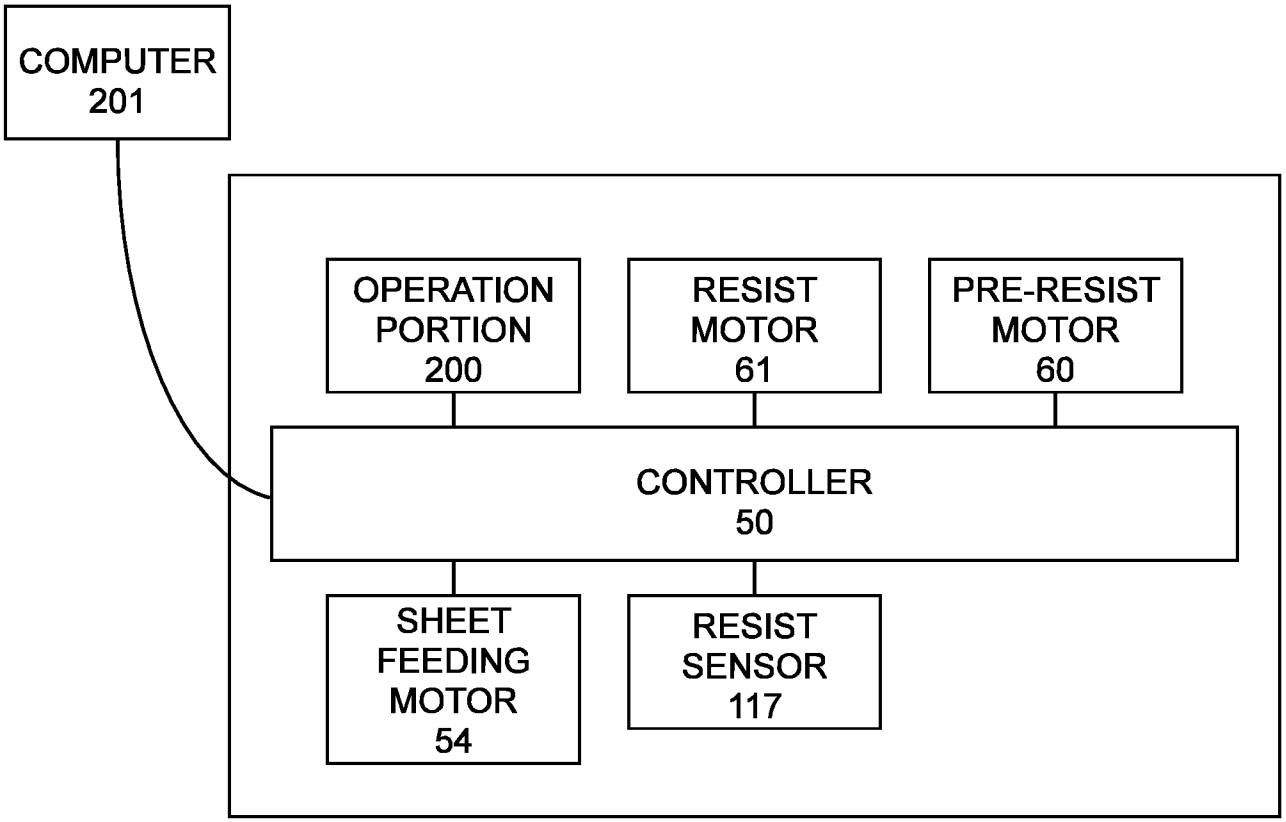
FIG. 3 is a block diagram of a controller provided in the sheet conveying apparatus.

Next, a controller of the printer 1 will be described. FIG. 3 is a block diagram of the controller 50 which is a control portion of the sheet conveying apparatus 3. An operation portion 200 of the printer 1, the resist motor 61, a preresist motor 60, a resist sensor 117 and a sheet feeding motor 54 are each connected to the controller 50 connected to an external computer 201 through a network.

The controller 50 outputs a signal to the sheet feeding motor 54 when a signal is output from the operation portion 200 or the connected external computer 201. The controller 50 sets a backward rotation start timing for the registration roller 120 to start backward rotation, and the backward rotation time for the registration roller 120 to rotate backward, based on the detection results by the resist sensor 117. Based on these, the controller 50 outputs signals to the resist motor 61 or the like to rotate forward or backward and stop the resist motor 61 with respect to the sheet conveying direction, and further controls backward start timing and backward rotation time (backward rotation amount).

Figure 4:
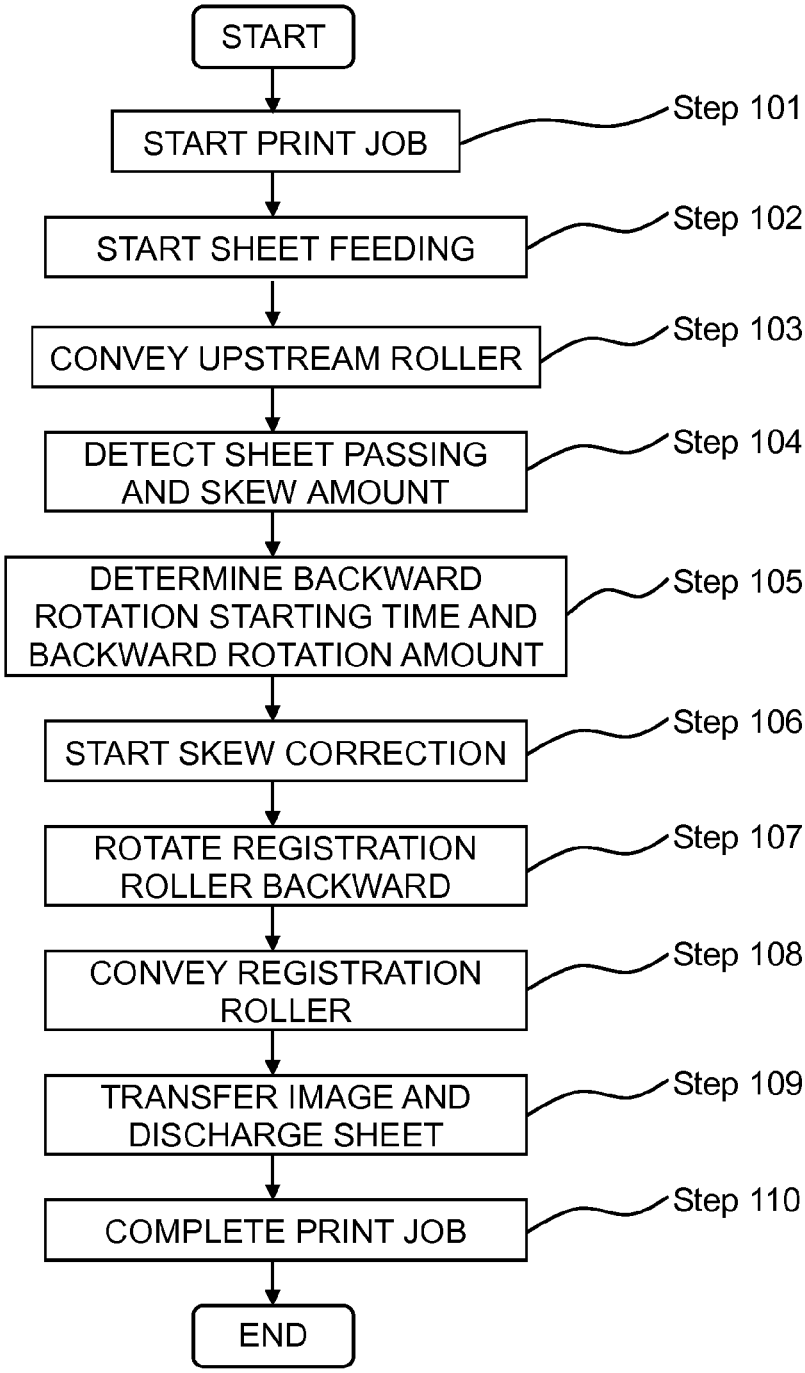
FIG. 4 is a flowchart showing the operation of sheet skew correction of the sheet conveying apparatus.

Next, the operation of the sheet conveying apparatus 3 configured as described above will be described in detail. When the start of a print job is executed by the external computer 201 connected by the network to the operation portion 200 of the printer 1 or the printer 1, supplying (feeding) of the sheet P starts (step 101 of FIG. 4, hereinafter referred to in brief as "SXXX"). When the feeding is started, the uppermost sheet is separated by the pickup roller 150 from the sheet bundle stacked in the sheet feeding cassettes 111 and 112 or the manual feeding portion 113 to be fed to the sheet conveying apparatus 3 (S102).

The sheet P fed to the sheet conveying apparatus 3 is conveyed at a given sheet conveying speed (so-called process speed), and after being conveyed to the upstream roller 115, is conveyed to the registration roller 120 by the upstream roller 115 (S103).

The leading edge downstream in the sheet conveying direction of the sheet P (hereinafter referred to in brief as a "downstream leading edge") conveyed by the upstream roller 115 is detected by the resist sensor 117. As the leading edge of the sheet P is detected by each of the resist sensors 117*a* to 117*d*, the skew amount S of the conveyed sheet is detected (S104).

Figure 7:
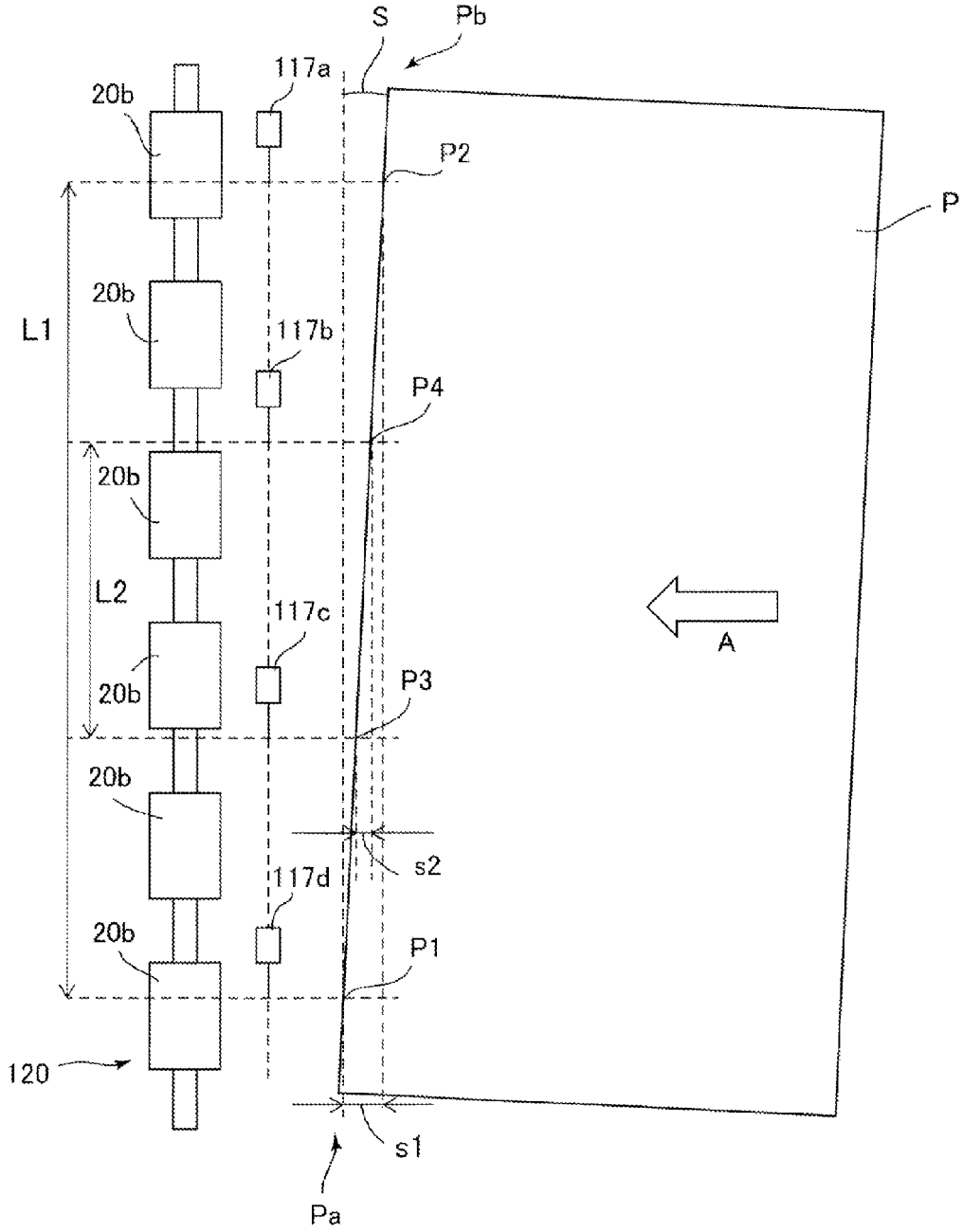
FIG. 7 is a view showing the state in which the sheet is conveyed askew on the registration roller.

Here, the skew amount S refers, as illustrated in FIG. 7, to a tilt angle (amount) of a corner portion Pb of the sheet leading edge on the side being retarded (hereinafter, referred to in brief as a "retarded corner portion") with respect to a corner portion Pa of the sheet leading edge on the side being advanced (hereinafter, referred to in brief as an "advanced corner portion"), in the conveying direction in the downstream leading edge of the sheet P.

Figure 5A:
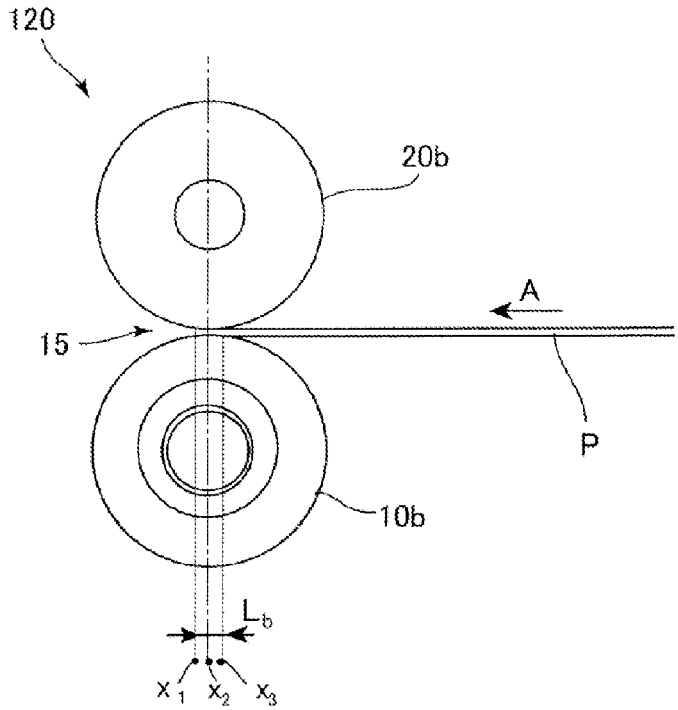
FIG. 5A is a side view showing the state in which the sheet has encroached on a nip portion of a registration roller.

Next, the phenomenon of encroachment of the sheet P on the registration roller 120 will be briefly described. The encroachment phenomenon refers, as illustrated in FIG. 5A, to the sheet P being conveyed toward the registration roller 120 by the upstream roller 115 entering the nip portion 15 of the registration roller 120. $X_2$ is a position of a center line of the registration roller 120, $X_3$ is a position at which the sheet has not encroached on the registration roller 120 but has stopped when the leading edge of the sheet P abuts, and $X_1$ is a position at which the leading edge of the sheet P has encroached on the registration roller 120 and stopped. The distance from the $X_1$ to $X_3$ becomes the encroachment amount Lb.

Figure 5B:
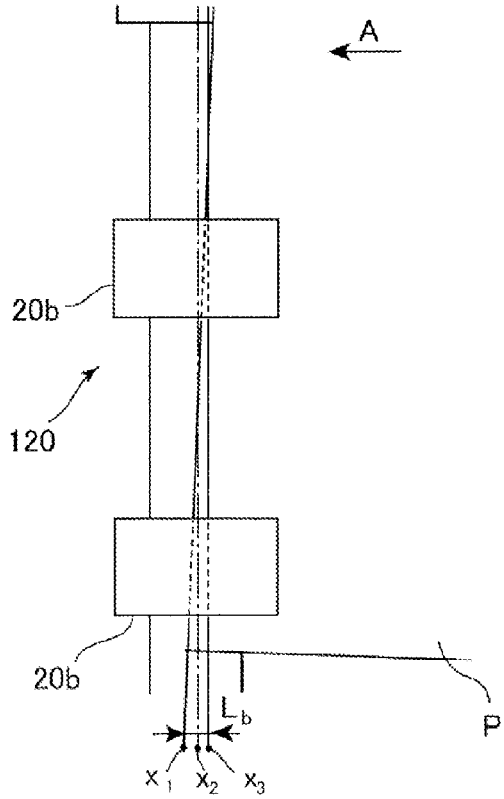
FIG. 5B is a plan view showing the state in which the sheet has encroached on the nip portion of the registration roller.
Figure 6:
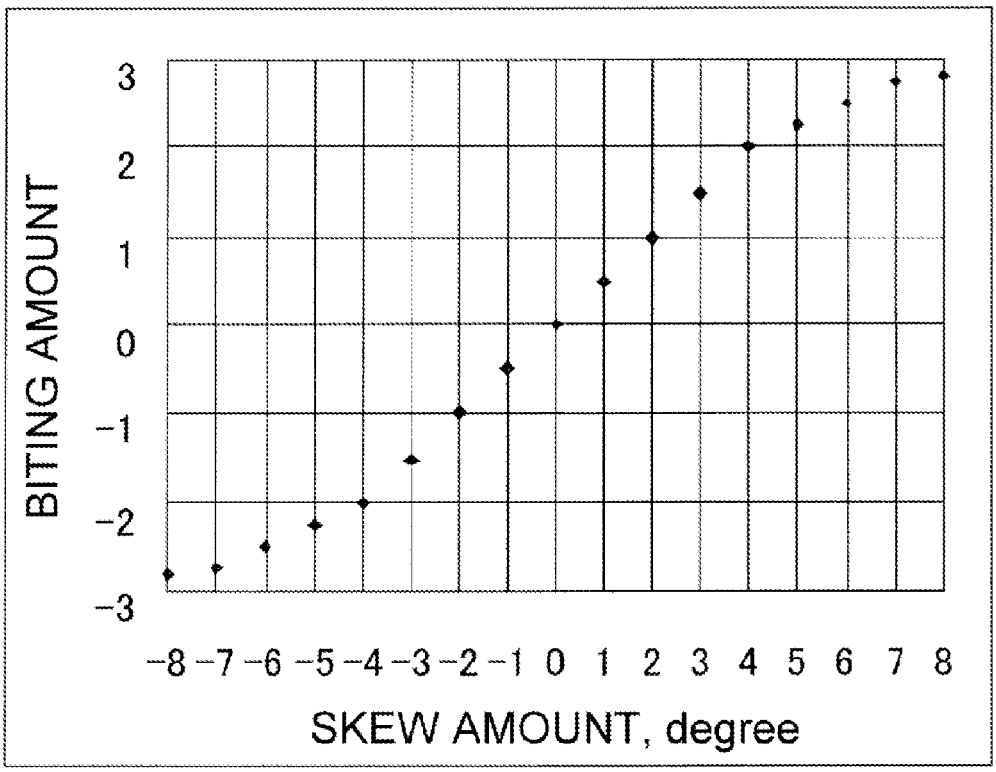
FIG. 6 is a graph showing the relationship between the skew amount of the sheet and the encroachment amount of the sheet.

FIG. 5B is a view showing the state in which the leading edge of the sheet P has encroached on the nip portion 15 of the registration roller 120. The greater the skew amount of the sheet P being conveyed is, the more easily the encroachment phenomenon occurs; the encroachment amount Lb depends greatly on the skew amount S. Like the graph illustrated in FIG. 6, the encroachment amount Lb of the sheet P into the nip portion 15 of the registration roller is increased almost in proportion to the skew amount S.

Next, detection of the skew amount S of the conveyed sheet P will be described in detail. Each of the resist sensors 117*a* to 117*d* detects the leading edge of the sheet P conveyed in the direction of arrow A from the upstream roller 115 in a skew feeding state. In the downstream leading edge of the sheet P, a time difference of passing time between both leading edges is obtained from a passing time of the leading edge P1 on the side advanced in the conveying direction detected by the resist sensor 117*d* and a passing time of the leading edge P2 on the side retarded in the conveying direction detected by the resist sensor 117*a*. A delay amount s1 is calculated by multiplying the time difference by the conveying speed of the sheet P conveyed.

As illustrated in FIG. 7, provided that the distance (interval) from the position at which the resist sensor 117*d* detects the advanced leading edge P1 of the sheet P to the position at which the resist sensor 117*a* detects the retarded leading edge P2 of the sheet P is L1, the skew amount S can be calculated (defined) from the skew amount s1 by the equation below.

$$S=a\tan(s1/L1) \quad \text{(Equation 1)}$$

When a sheet with the width narrower than the distance (interval) L1 between the detection position of the resist sensor 117*a* and the detection position of the resist sensor 117*d* is conveyed, the resist sensor 117*c* and the resist sensor 117*b* detect the leading edge of the sheet.

In the downstream leading edge of the sheet P, a time difference of passing time between both leading edges is obtained from a passing time of the advanced leading edge P3 in the conveying direction detected by the resist sensor 117*c* and a passing time of the retarded leading edge P4 in the conveying direction detected by the resist sensor 117*b*. A delay amount s2 is calculated by multiplying the time difference by the conveying speed of the conveyed sheet P.

As illustrated in FIG. 7, if the distance (interval) from the position at which the resist sensor 117*c* detects the advanced leading edge P3 of the sheet P to the position at which the resist sensor 117*b* detects the retarded leading edge P4 of the sheet P is L2, the skew amount S can be calculated (defined) from the skew amount s2 by the following equation.

$$S=a\tan(s2/L2) \quad \text{(Equation 2)}$$

The controller 50 rotates the registration roller 120 backward to prevent the sheet P from encroaching on the nip portion 15 of the registration roller. The controller 50 sets the backward rotation time for the registration roller 120 to rotate backward from the skew amount S of the sheet P detected by the resist sensor 117 (S105).

Next, the changing of the backward rotation time of the registration roller 120 will be described in detail. As described above, the encroachment amount Lb tends to be proportional to the skew amount S of the sheet P; the greater the skew amount S of the sheet P is, the more the encroachment amount of the sheet P on the nip portion 15 of the registration roller becomes. Therefore, the greater the skew amount S of the sheet P is, the longer the backward rotation time of the registration roller 120 (the greater the backward rotation amount) is set, with the leading edge of the sheet contacting the registration roller 120. On the other hand, the smaller the skew amount S of the sheet P is, the shorter the backward rotation time of the registration roller 120 (the smaller the backward rotation amount) is set. The encroachment amount G of the sheet for calculating the backward rotation time (backward rotation amount) of the registration roller 120 can be calculated (defined) by the following equation using the skew amount S and a proportional constant a (S105).

$$G=a\cdot S \quad \text{(Equation 3)}$$

The backward rotation time of the registration roller 120 is set by the controller 50 to correspond to the encroachment amount G. In addition, the backward rotation timing for starting the backward rotation of the registration roller 120 is set to correspond to the backward rotation time of the registration roller 120 (S105).

Next, the backward rotation operation of the registration roller 120 will be described in detail. After the leading edge of the conveyed sheet P is detected by the resist sensor 117 and the leading edge of the sheet has passed the resist sensor 117, the registration roller 120 starts rotation in the direction opposite to the conveying direction of the sheet P by the backward rotation of the resist motor 61.

At this time, if the registration roller 120 stops backward rotation before skew correction of the sheet P is completed, there is a concern that the sheet P will encroach on the nip portion 15 of the registration roller again, and the loop R will need to be formed to correct for the skew of the sheet P. In such a case, a sufficient effect of skew correction cannot be obtained. Therefore, setting is performed such that the backward rotation of the registration roller 120 continues until the retarded corner portion Pb of the downstream leading edge of the skewed sheet P abuts the nip portion 15 of the registration roller (S105). That is, with the whole region of the downstream leading edge of the sheet abutting the nip portion of the registration roller, the controller 50 stops the backward rotation of the registration roller 120 once the skew of the sheet is corrected for.

The start time of the backward rotation, which is the start timing of the backward rotation of the registration roller 120, is set based on the time at which the retarded corner portion Pb of the downstream leading edge of the sheet P abuts the nip portion 15 of the registration roller, when the skew correction of the sheet P is completed. For this, the time t_G2 when the retarded corner portion Pb of the downstream leading edge of the sheet P abuts the nip portion 15 of the registration roller is calculated.

Figure 8:
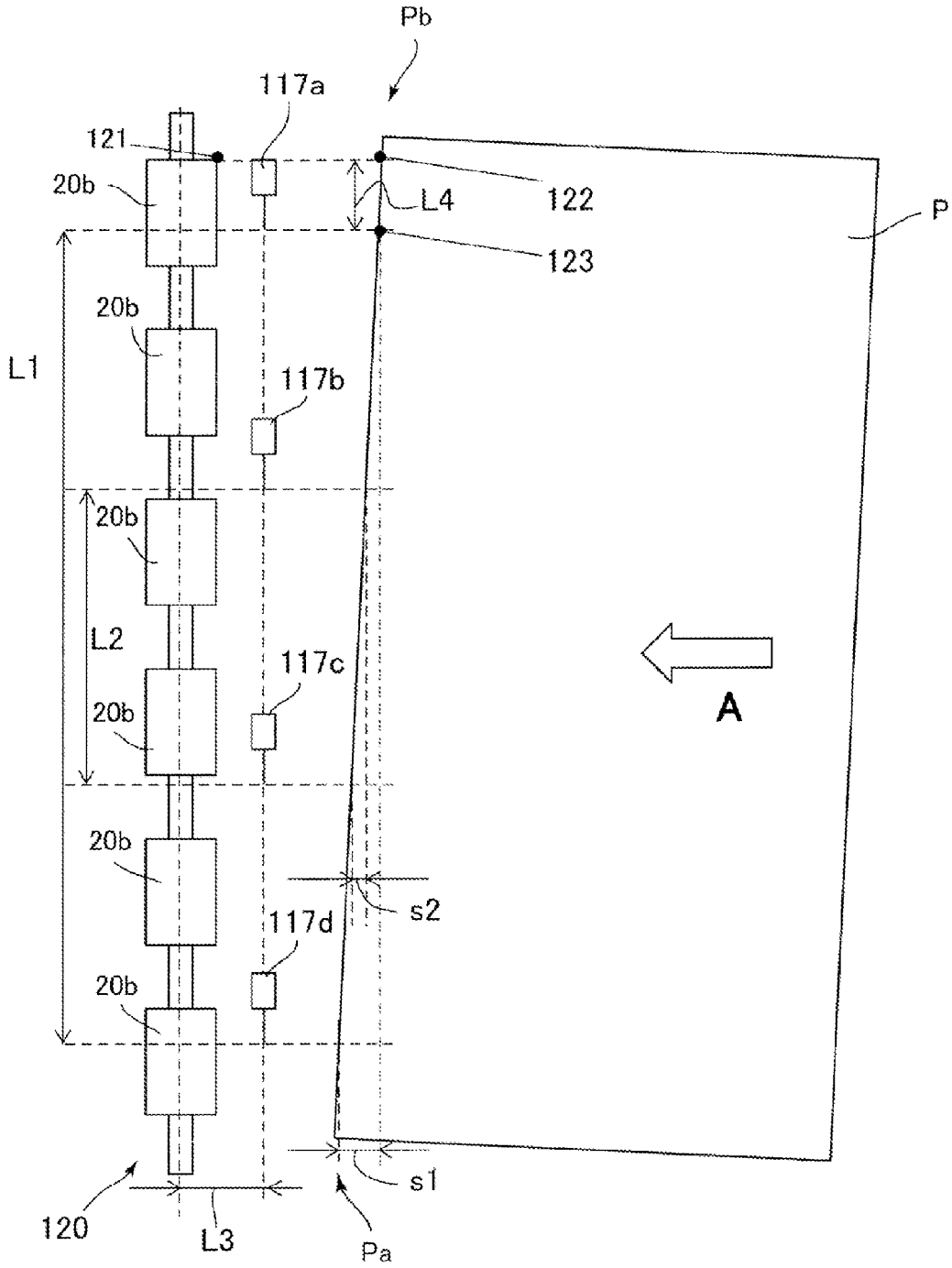
FIG. 8 is a view showing the state in which the sheet is conveyed askew on the registration roller.

Next, calculation of the time t_G2 will be described in detail. Time t_a is the time at which the leading edge 123 of the sheet P reaches the sheet leading edge detection position of the resist sensor 117*a*, as illustrated in FIG. 8. As for the conveying direction of the sheet, the distance from the sheet leading edge detection position of the resist sensor 117 to the nip portion 15 of the registration roller is referred to as L3. As for the width direction of the sheet conveying direction, the distance from the leading edge 123 of the sheet P to the leading edge 122 of the retarded corner portion Pb of the sheet P that abuts the position 121 of the widthwise outer end portion of the roller 20*b* arranged outermost is referred to as L4. Further, the conveying speed of the sheet v and t_G2 from the skew amount S is calculated by the following equation.

$$t_G2=t_a+\{(L3+L4)\tan(S)\}/v \quad \text{(Equation 4)}$$

The time t_G2 at which the leading edge 122 of the retarded corner portion Pb of the sheet P abuts the nip portion 15 of the registration roller, and the start time of the backward rotation of the registration roller 120 from the backward rotation time that is changed based on the skew amount S are determined. Based on these, the backward rotation start time is set such that the smaller the detected skew amount S is, the shorter the backward rotation time becomes (the smaller the backward rotation amount becomes), and the backward rotation stop of the registration roller 120 becomes later than t_G2 (S105).

Figure 9:
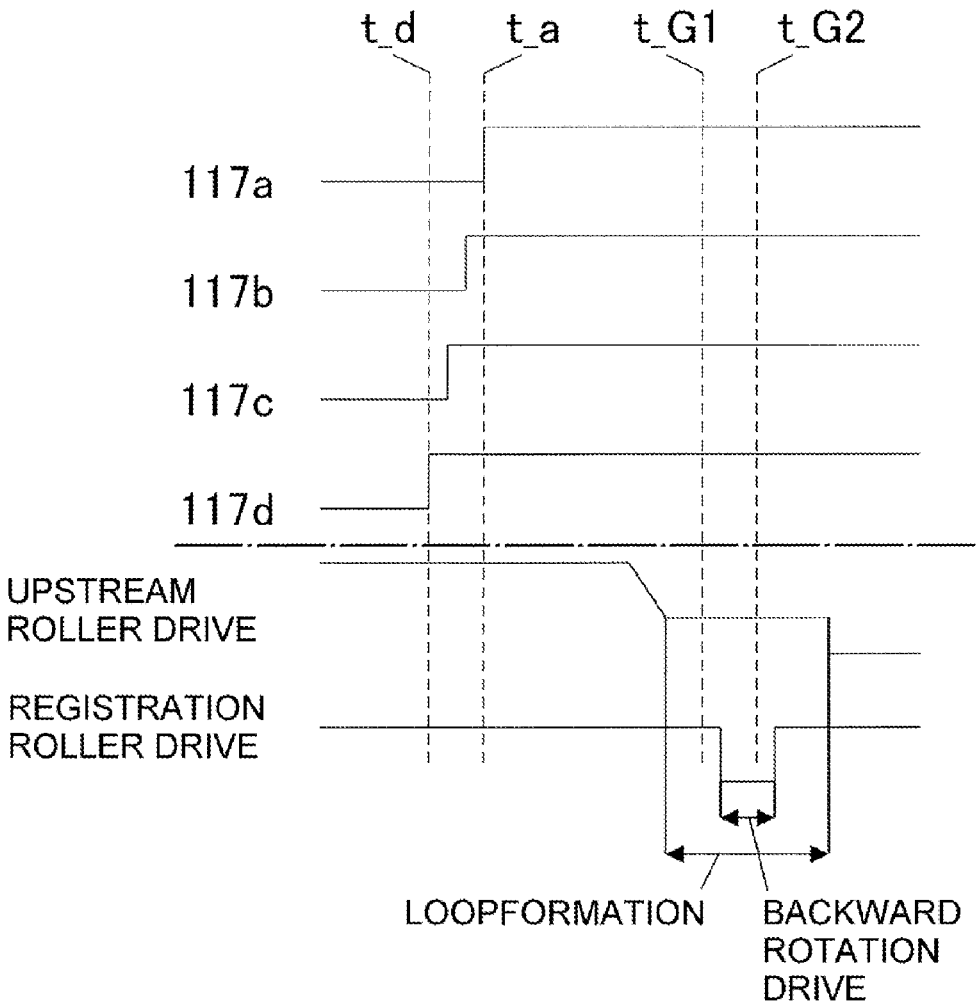
FIG. 9 is a time chart showing the rotating operation of the registration roller.

FIG. 9 is an example of the timing chart for the operation of the registration roller that is set such that the rotation drive of the registration roller stops later than t_G2, the time at which the leading edge 122 of the retarded corner portion Pb of the sheet P abuts the nip portion 15 of the registration roller. In FIG. 9, t_G1 is the time at which the advanced corner portion Pa of the sheet P abuts the nip portion 15 of the registration roller 120. As illustrated in FIG. 9, the backward rotation of the registration roller 120 is started after time t_G1 has passed. That is, the registration roller 120 rotates backward in a state in which the leading edge of the sheet abuts the registration roller 120. In addition, the backward rotation of the registration roller 120 is stopped after time t_G2 has passed. Unlike the example in FIG. 9, the stop of the backward rotation of the registration roller 120 becomes later than the time t_G2, even when the backward rotation of the registration roller 120 starts earlier than the time t_G1 from the time t_G2 and the backward rotation time of the registration roller 120.

When the backward rotation time and the start time of the backward rotation for the registration roller 120 are set by the controller 50, the skew correction of the sheet P starts (S106), and the registration roller 120 starts backward rotation at the set start time of the backward rotation (S107).

Figure 10A:
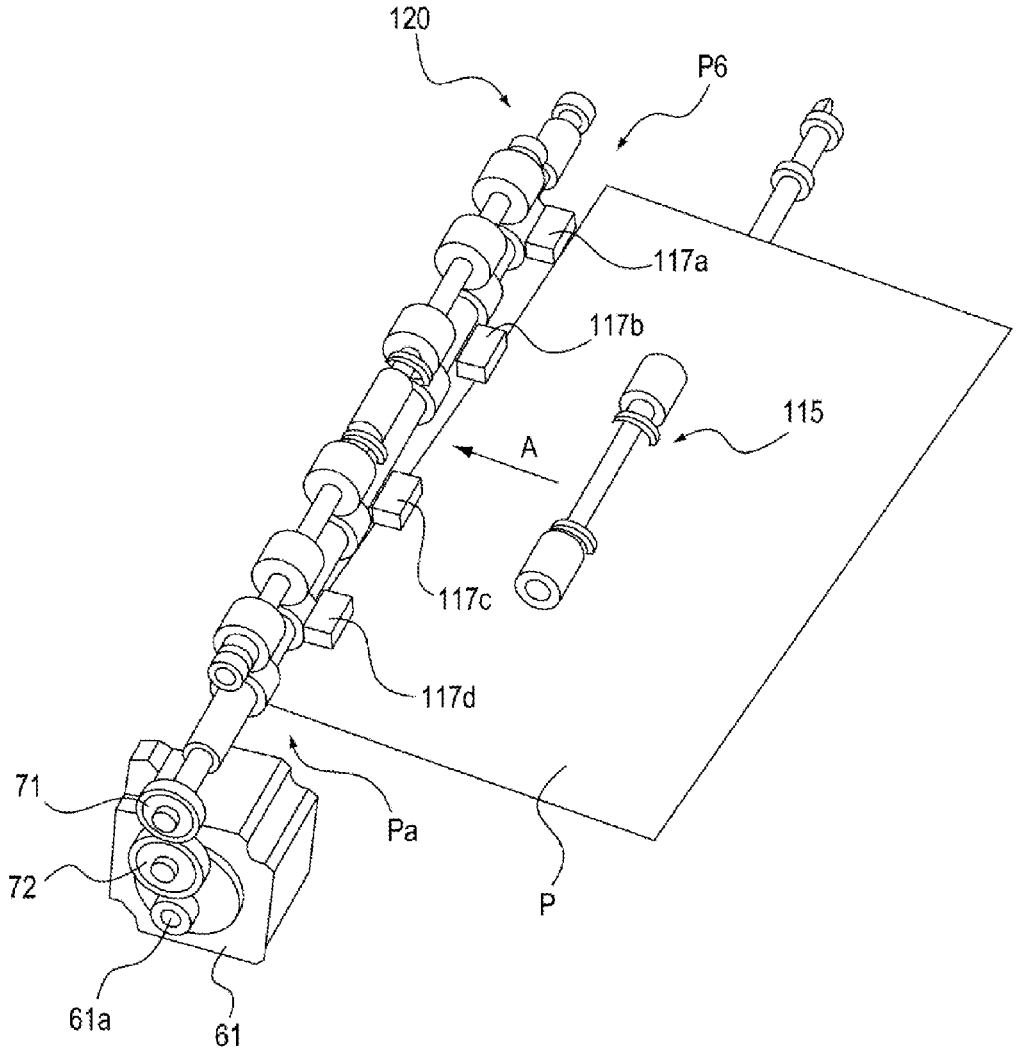
FIGS. 10A, 10B and 10C are perspective views showing the operation of skew correction of the sheet of the skew correction apparatus provided in the sheet conveying apparatus, each of which shows a different state.
Figure 10B:
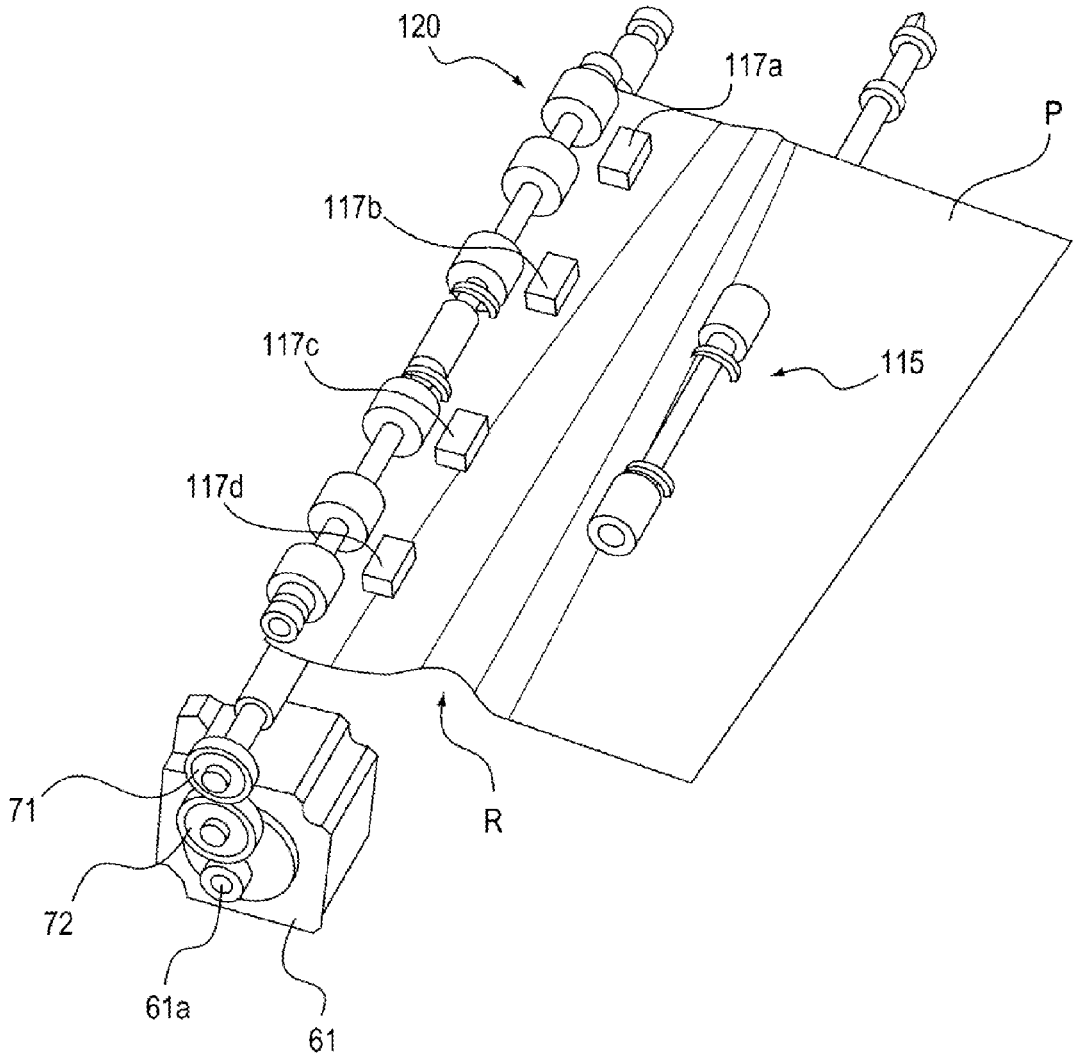
Figures 11A, 11B, 11C:
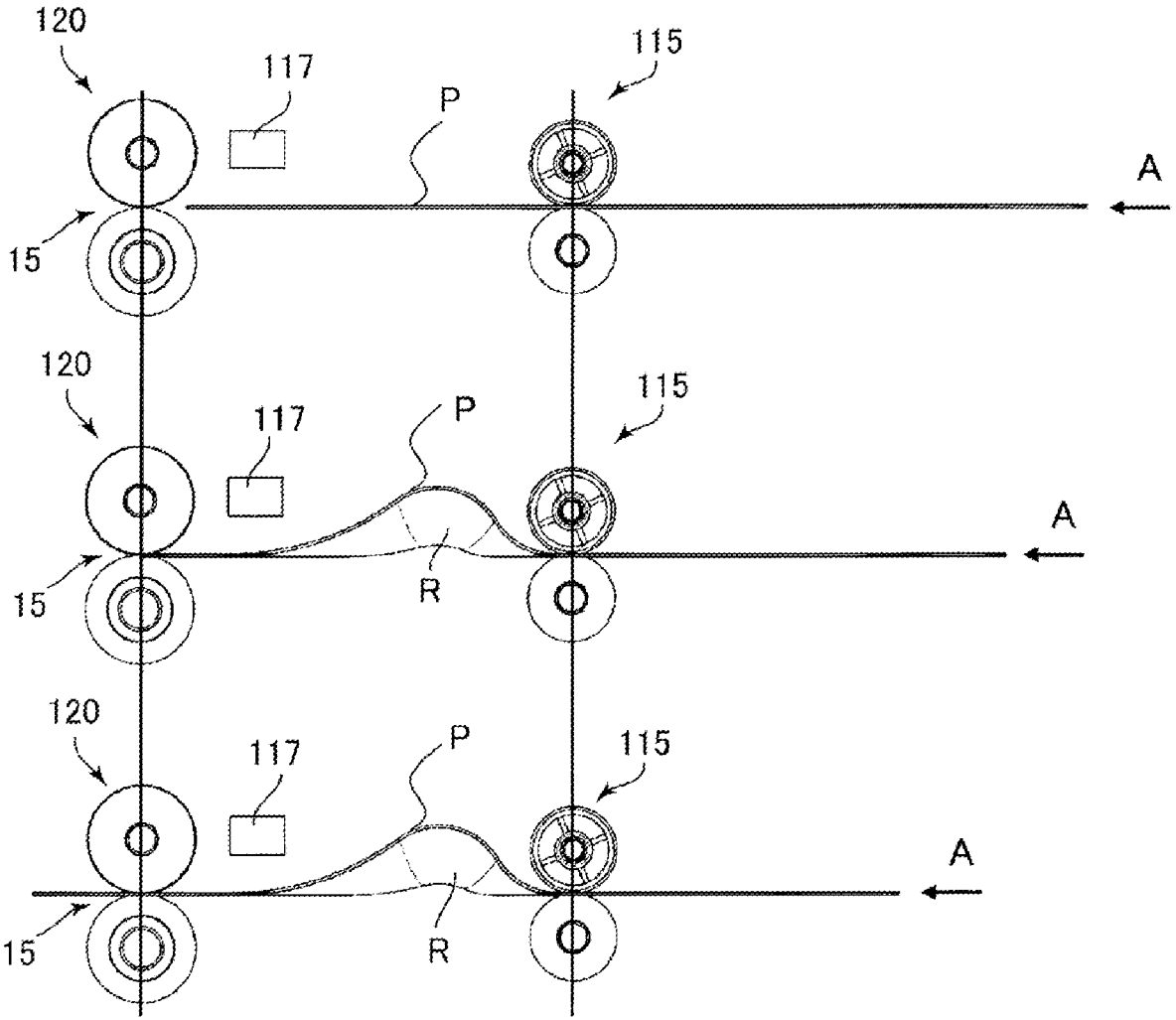
FIGS. 11A, 11B and 11C are side views showing the operation of skew feeding correction of the skew correction apparatus included in the sheet conveying apparatus, each of which shows a different state.

As illustrated in FIGS. 10A and 11A, the sheet P conveyed to the registration roller 120 continues to be conveyed in the arrow A direction by the upstream roller 115 even after the leading edge of the sheet P abuts the nip portion 15 of the registration roller. By the force pushing out the sheet P ahead by the conveying of the upstream roller 115, the sheet P is bent so as to form a loop, as illustrated in FIGS. 10B and 11B.

By the force pushing out the leading edge of the sheet P by the loop R formed like this, the retarded corner portion Pb of the sheet P is pushed out toward the registration roller 120. As the retarded corner portion Pb of the sheet P is pushed out toward the registration roller 120, the whole of the leading edge downstream of the sheet conveying direction rotates to correct for the skew of the sheet.

Figure 10C:
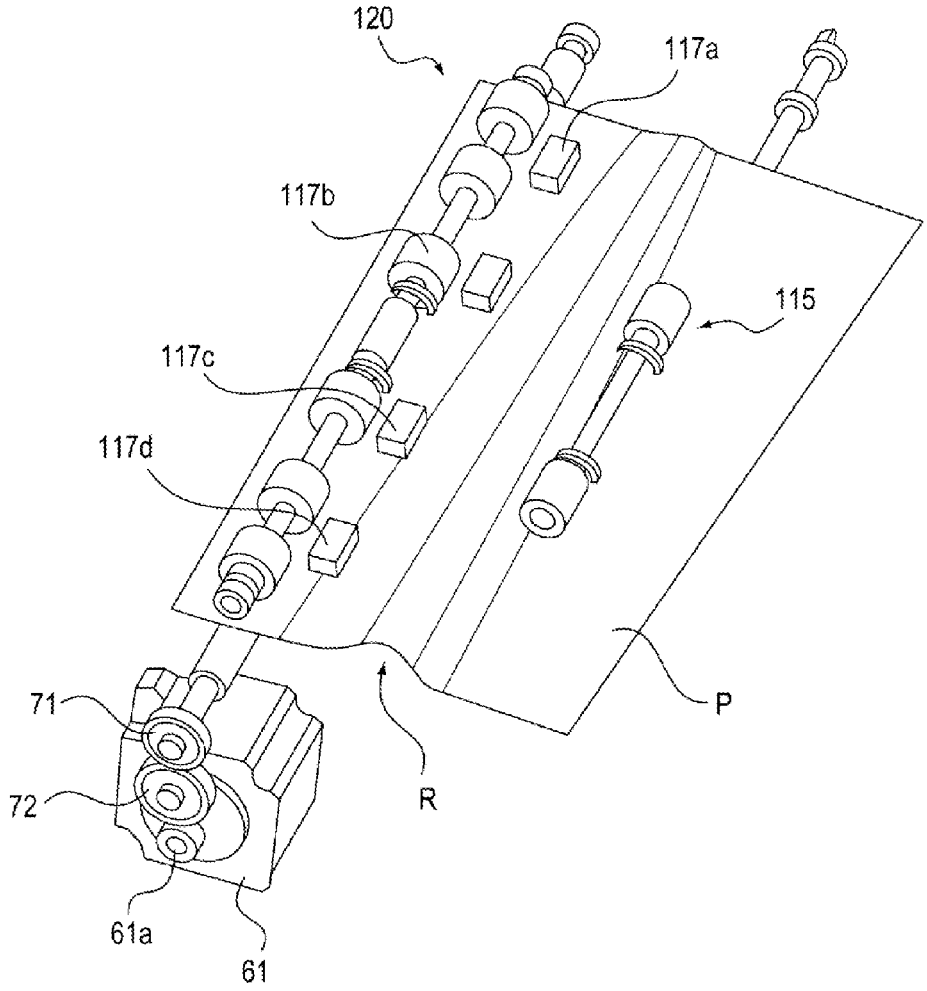

After the skew of the sheet P is corrected, the registration roller 120 is rotated forward again by the resist motor 61 to convey the sheet P to the secondary transferring portion 118, as illustrated in FIGS. 10C and 11C. The sheet P that has the image transferred on the sheet P in the secondary transferring portion 118 is discharged out of the printer 1 after the image is fixed in the fixing portion 110 on the sheet (S109), and printing by the printer 1 is completed (S110).

As described above, the skew amount S of the sheet is detected, and based on the detected skew amount S, the backward rotation time of the registration roller 120 is changed to rotate backward until the retarded corner portion Pb of the downstream leading edge of the sheet P abuts the nip portion 15 of the registration roller. As the registration roller 120 is thus rotated backward at the backward rotation time reduced depending on the skew amount S of the sheet to suppress the damage such as "leading edge curling" or "leading edge folding" being generated on the sheet P, it is possible to resolve the state in which the leading edge of the sheet P encroaches on the nip portion 15 of the registration roller. By rotating the registration roller backward, it is also possible to prevent the leading edge of the sheet P from encroaching on the nip portion 15 of the registration roller.

Further, it is also possible to shorten the total skew correction time of the sheet P since the interval between the forward rotation and the backward rotation is shortened by setting the backward rotation time of the registration roller 120 to the minimum. It is also possible to increase the printing speed of the printer 1, because the conveying efficiency of the sheet conveying apparatus is improved.

In the present embodiment, four resist sensors 117 which detect the sheet leading edge downstream of the sheet conveying direction were arranged across the sheet conveying direction, but only two resist sensors 117*b* and 117*c* that can detect the skew amount S of the sheet P of minimum width may be included.

In addition, the controller 50 included in the sheet conveying apparatus may be configured so as to have the backward rotation time changed such that the higher the rigidity Z of the sheet P conveyed to the registration roller 120 is, the longer the backward rotation time of the registration roller 120 becomes.

Here, the proportional constant a of Equation 3 is calculated from the following equation by using a given proportional constant b in a function of the rigidity Z of the sheet P.

$$a=b\cdot Z \qquad \text{(Equation 5)}$$

By using the calculated a, the backward rotation time is changed depending on the rigidity Z of the sheet P from the skew amount S.

As described above, change is performed such that the higher the rigidity Z of the conveyed sheet P is, the longer the backward rotation time of the registration roller 120 becomes. Thereby, if a sheet P of high rigidity is conveyed to the registration roller 120 as the rotary driving force of the resist motor 61 is transmitted to the gears 71 and 72, as illustrated in FIG. 2, the encroachment amount becomes greater as the registration roller 120 is rotated by the backlash of the gears 71 and 72. Like this, even if the sheet P of high rigidity, which makes the encroachment amount to the registration roller 120 greater, is conveyed, it is possible to resolve the encroachment of the sheet P on the registration roller with a high degree of precision.

Figure 12B:
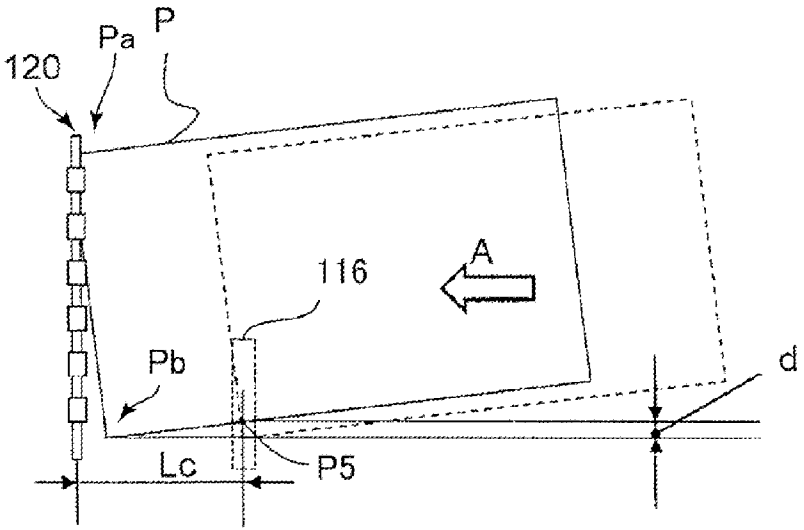
FIG. 12B is a plan view of the apparatus of FIG. 12A.
Figure 12A:
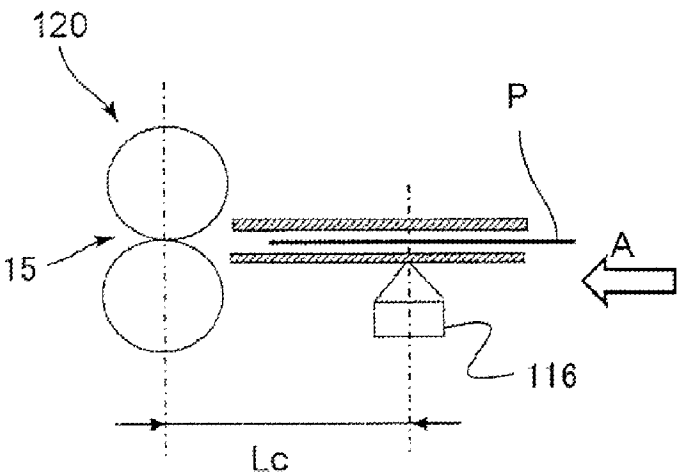
FIG. 12A is a side view of an apparatus which includes a contact image sensor as a sensor provided in the sheet conveying apparatus.
Figure 13A:
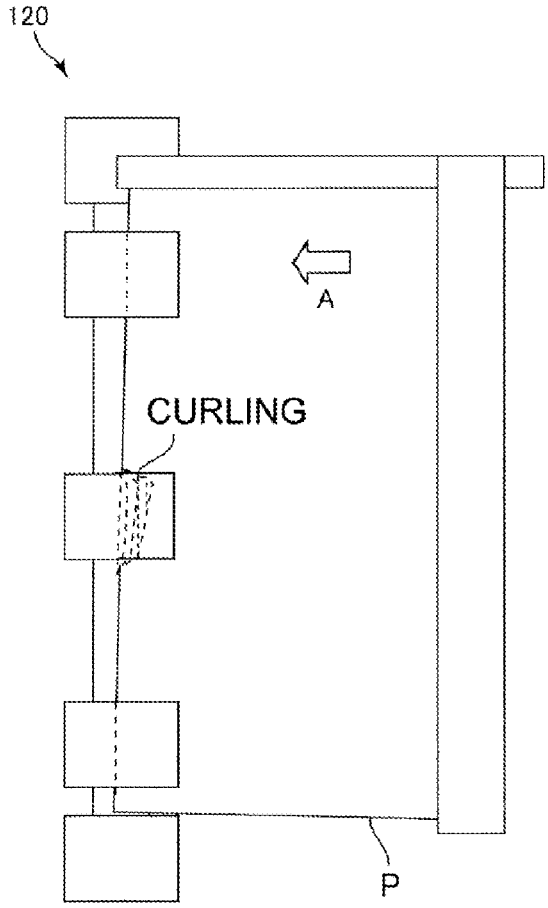
FIG. 13A PRIOR ART
FIG. 13A is a plan view showing the state of "leading edge curling" or "leading edge folding" of a sheet generated by the operation of sheet skew correction in a conventional sheet conveying apparatus.
Figure 13B:
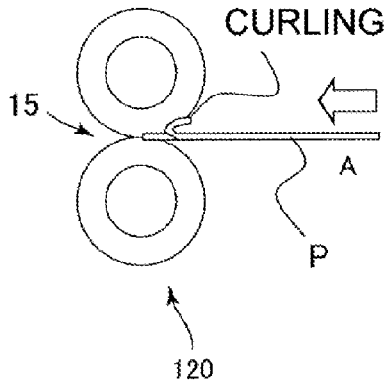
FIG. 13B PRIOR ART
FIG. 13B is a side view of FIG. 13A.

The resist sensor that detects the leading edge of the conveyed sheet P may also be configured to be installed across the CIS (Contact Image Sensor), an optical line sensor, at right angles with the sheet conveying direction, as illustrated in FIGS. 12A and 12B.

Here, the CIS will be described briefly. The CIS is one of optical sensors of light and compact construction, in which modules including a light source, a light system, and light amount detection system are made as one body.

The resist sensor 116 including the CIS detects the leading edge plane downstream in the conveying direction of the sheet P being conveyed to determine the backward rotation start timing of the registration roller 120 and also continually detects the change of the lateral cross section along the conveying direction to detect the skew amount S.

As for the sheet skew amount S, as illustrated in FIG. 12, the CIS detects the retarded corner portion Pb of the downstream leading edge of the sheet P and also detects the side edge along the conveying direction of the sheet P. When the advanced corner portion Pa of the sheet P abuts the nip portion 15 of the registration roller, the side edge P5 along the conveying direction of the sheet P is detected. From the side edge P5 along the conveying direction of the sheet P, a travel amount d that the side edge has moved along the conveying direction of the sheet P in the sheet width direction crossing the sheet conveying direction at right angles from the position of the detected retarded corner portion Pb is detected.

As illustrated in FIG. 12, if the travel amount is d and the distance (interval) from the detection position of the sheet P of the resist sensor 116 to the nip portion 15 of the registration roller is Lc, the skew amount S is calculated by the following equation.

$$S=a\tan(d/Lc) \qquad \text{(Equation 6)}$$

As described above, the skew amount S of the sheet P can be detected properly by detecting the lengthwise side edge of the sheet P by the CIS. By using a relatively low-priced CIS for the resist sensor 116 that detects the leading edge of the sheet P, the manufacturing cost can be reduced.

Note that, the embodiment of the sheet conveying apparatus according to the present invention is described as a color digital printer, which is one of image forming apparatuses, as an example, but the present invention is not limited thereto, and can obviously be applied to a printer of an ink jet type as well.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-195286, filed Sep. 7, 2011, which is hereby incorporated by reference herein in its entirety.

What is claimed is:

1. A sheet conveying apparatus comprising:

an upstream roller which conveys a sheet;

a downstream roller which is installed downstream from the upstream roller and conveys the sheet conveyed by the upstream roller, wherein the sheet conveyed by the upstream roller abuts the downstream roller to form a loop in the sheet so as to correct for skew of the sheet;

a driving apparatus which rotates the downstream roller forward or backward, wherein if the driving apparatus rotates the downstream roller forward, the sheet is conveyed downstream in the conveying direction, and if the driving apparatus rotates the downstream roller backward, the sheet is conveyed upstream in the conveying direction;

a detection portion which detects the skew of the sheet before the sheet conveyed by the upstream roller abuts the downstream roller; and a controller which determines the backward rotation amount for the downstream roller to rotate backward based on the detection results of the detection portion and controls the driving apparatus to rotate the downstream roller backward based on the backward rotation amount determined by the controller with the sheet conveyed by the upstream roller abutting the downstream roller.

2. The sheet conveying apparatus according to claim 1, wherein the detection portion detects a leading edge in the conveying direction of the conveyed sheet, and wherein the controller controls the driving apparatus based on the detection results by the detection portion so as to stop the backward rotation of the downstream roller, after the whole region of the leading edge in the conveying direction of the conveyed sheet abuts the downstream roller.

3. The sheet conveying apparatus according to claim 1, wherein the controller sets the backward rotation amount such that the greater the skew amount of the sheet detected by the detection portion is, the greater the backward rotation amount becomes.

4. The sheet conveying apparatus according to claim 1, wherein the controller sets the backward rotation amount such that the higher the rigidity of the conveyed sheet is, the greater the backward rotation amount becomes.

5. An image forming apparatus comprising:

sheet conveying portion having, an upstream roller which conveys a sheet;

a downstream roller which is installed downstream from the upstream roller and conveys the sheet conveyed by the upstream roller, wherein the sheet conveyed by the upstream roller abuts the downstream roller to form a loop in the sheet so as to correct for skew of the sheet;

a driving apparatus which rotates the downstream roller forward or backward, wherein if the driving apparatus rotates the downstream roller forward, the sheet is conveyed downstream in the conveying direction, and if the driving apparatus rotates the downstream roller backward, the sheet is conveyed upstream in the conveying direction;

a detection portion which detects the skew of the sheet before the sheet conveyed by the upstream roller abuts the downstream roller; and a controller which determines the backward rotation amount for the downstream roller to rotate backward based on the detection results of the detection portion and controls the driving apparatus to rotate the downstream roller backward based on the backward rotation amount determined by the controller with the sheet conveyed by the upstream roller abutting the downstream roller, and, image forming portion which forms image on the sheet conveyed from the sheet conveying portion.

6. The image forming apparatus according to claim 5, wherein the detection portion detects a leading edge in the conveying direction of the conveyed sheet, and wherein the controller controls the driving apparatus based on the detection results by the detection portion so as to stop the backward rotation of the downstream roller, after the whole region of the leading edge in the conveying direction of the conveyed sheet abuts the downstream roller.

7. The image forming apparatus according to claim 6, wherein the controller sets the backward rotation amount such that the greater the skew amount of the sheet detected by the detection portion is, the greater the backward rotation amount becomes.

8. The image forming apparatus according to claim 7, wherein the controller sets the backward rotation amount such that the higher the rigidity of the conveyed sheet is, the greater the backward rotation amount becomes.

* * * * *